United States Patent [19]

Eimer

[11] Patent Number: 4,830,099

[45] Date of Patent: May 16, 1989

[54] APPARATUS FOR EXTRACTING CLEANING BODIES FROM A LIQUID

[75] Inventor: Klaus Eimer, Ratingen, Fed. Rep. of Germany

[73] Assignee: Taprogge GmbH, Wetter, Fed. Rep. of Germany

[21] Appl. No.: 69,393

[22] Filed: Jul. 2, 1987

[30] Foreign Application Priority Data

Jul. 3, 1986 [DE] Fed. Rep. of Germany ..... 3622396

[51] Int. Cl.[4] ..... F28G 1/12

[52] U.S. Cl. ..... 165/95; 15/3.51

[58] Field of Search ..... 165/95; 15/3.51; 210/413, 414, 321.7

[56] References Cited

U.S. PATENT DOCUMENTS

| | | | |
|---|---|---|---|
| 3,269,543 | 8/1966 | Treplin | 210/316 |
| 4,113,008 | 9/1978 | Treplin et al. | 165/95 |
| 4,135,574 | 1/1979 | Treplin et al. | 165/95 |
| 4,523,634 | 6/1985 | Bizard | 165/95 |
| 4,539,115 | 9/1985 | Patzig | 210/409 |
| 4,680,113 | 7/1987 | Eimer et al. | 210/181 |

FOREIGN PATENT DOCUMENTS

| | | | |
|---|---|---|---|
| 60-44800 | 3/1985 | Japan | 165/95 |
| 61-165596 | 7/1986 | Japan | 165/95 |

*Primary Examiner*—Samuel Scott
*Assistant Examiner*—Allen J. Flanigan
*Attorney, Agent, or Firm*—Banner, Birch, McKie and Beckett

[57] ABSTRACT

Apparatus for extracting cleaning bodies from a cooling liquid after flowing through the tubes of a heat exchanger as a pipe section casing with at least one layer of screens arranged in a V-shaped manner mounted to be pivoted for through-washing includes a device for receiving the cleaning bodies collected in a strip-like section from both screens and a guide member arranged above the device for aligning the cooling fluid flow more parallel to the screen surfaces directly upstream from the strip section. The apparatus is characterized in that the guide member is provided with two vortex members running parallel to the strip section with each vortex member being associated with one of the two screens to form one vortex zone with at least one point within the vortex zone terminating in an opening of a pipe for sucking off the cleaning bodies.

11 Claims, 2 Drawing Sheets

APPARATUS FOR EXTRACTING CLEANING BODIES FROM A LIQUID

Figure 1:
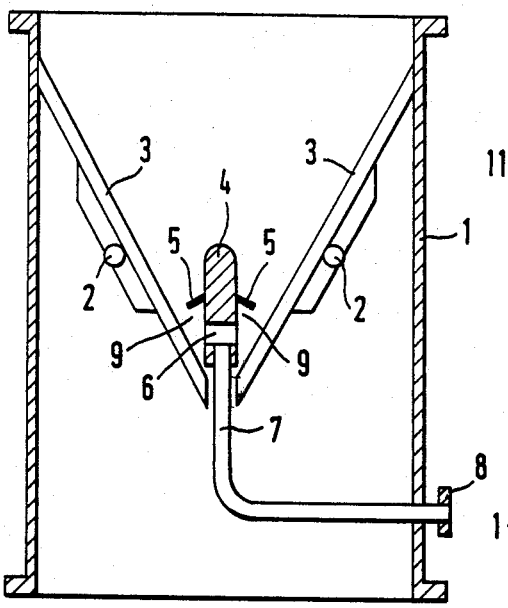

The invention relates to an apparatus for extracting cleaning bodies from a cooling liquid after flowing through the tubes of a heat exchanger, which comprises a pipe section as a casing, at least one pair of V-shaped-arranged screens, which are pivotable for through-washing, a device for receiving the cleaning bodies collected from both sides in a strip section and a guide member arranged above the device for aligning the cooling liquid flow more parallel to the screen surface directly upstream of the strip section.

Such an apparatus basically is known from German Pat. No. 1,227,040. In this apparatus below the strip-like section there is provided a further sieve or screen arrangement in V-shaped form, with the aid of which the cleaning bodies passing in a substantially linear manner through the strip section are directed to a single point and are removed by suction using a pipe. In order to free said further screen arrangement from impurities below the strip section, the flow into the screens can be blocked, so that there is a reversal of the through-flow for cleaning purposes. For these cleaning periods, the impurities are sucked off through this same pipe otherwise used for removing the cleaning bodies from the overall apparatus.

The construction expenditure for the known apparatus is extremely high. In addition, due to the further screen arrangement below the strip section, there is considerable overall length, which leads to difficulties in housing the apparatus downstream from a power station condenser or the length makes such an installation completely impossible. Attempts have therefore already been made to remove the cleaning bodies from the strip section through the arrangement of two whirl tubes into which, enriched with cleaning bodies as a result of the screen arrangement, there tangentially flows a part of the cooling liquid. On the resulting vortex or eddy flow there is superimposed a lateral component obtained through suction action and which ensures the transfer of the cleaning bodies to a pipe issuing into the whirl tube.

However, even such a screen means with a whirl tube has to have a stepped arrangement of the two screens, so that once again a considerable overall length of the overall apparatus is necessary. Admittedly the overall length is not as great as in the first-mentioned apparatus, but from the aspect of the screen dimensions the use of whirl tubes does not permit a minimum overall length. A further disadvantage of the last-mentioned manner of removing the cleaning bodies with the aid of a whirl tube is that the first-mentioned apparatus can only be re-equipped with great difficulty. Thus, this latter apparatus is mainly directed at reducing the constructions expenditure than at obtaining a short overall length. The desired simplification is not achieved because stepped screens are necessary in conjunction with whirl tubes.

An object of the present invention is therefore to so improve an apparatus of the aforementioned types that, in the case of a funnel-shaped or V-shaped arrangement of the screens, can be supplemented to an arrangement of four, six, etc. screens by doubling. In the case of new manufacture an extremely short overall length can be obtained and the operational reliability can be increased on existing apparatus, whilst retaining important parts, such as the screens, by reducing the moving components.

According to the invention this object is achieved in that the guide member is provided with two vortex or eddy means arranged parallel to the strip section, each member facing one of the two screens for forming in each case one vortex or eddy zone. Also at one or several points within each vortex zone the zone terminates at an outlet of a pipe for sucking off the cleaning bodies.

The vortex means according to the invention produces a very turbulent liquid zone, which contains adequate force components against the general flow direction to keep permanent movement of the cleaning bodies which have entered said zone, thereby preventing any deposition at any point. Due to the suction effect at the pipe outlet or opening said turbulent liquid zone contains a flow component in the direction of the pipe opening, so that any cleaning body entering said zone sooner or later is sucked into the pipe opening. The lateral flow component is not particularly clean and is not comparable with a vortex flow with superimposed longitudinal component, so that the cleaning bodies flow into the pipe opening under the influence of a statistical chance rather than a precisely calculable time lapse. However, if necessary, all the cleaning bodies are removed from one circulation through the tubes of a heat exchanger, if there is adequate extraction time. In other words, the collecting cycle is continued for a certain time even if already 95% of the cleaning bodies have been collected in corresponding means.

It has surprisingly been found that an ideal vortex flow with superimposed longitudinal component as formed in the above-described vortex tube towards whose opening there is a parallel flow is not necessary for the complete extraction of the cleaning bodies from the cooling liquid and that instead a disordered flow behind the vortex means is sufficient for collecting and extracting all the cleaning bodies contained in the cooling liquid flow. Consequently there is no need for a stepped arrangement of the screens, which leads to two advantages. Firstly, existing screen means with screens arranged in funnel-shaped manner can be re-equipped according to the invention and secondly in the case of new manufacture of corresponding apparatus a particularly compact construction can be obtained using very little construction expenditure and the cheapest components, such as flat-bar steel members and the like.

In most cases the vortex means comprise vortex plates, which project laterally from the guide member.

For the lower limitation of the vortex zones a deflector plate can be provided, which simultaneously limits the working zone of the screens at their lower ends. This forms a type of lower termination for the strip section. Above said deflector plate in the region up to the vortex plates, the guide member can be reduced to a single web, so that there is a relatively large vortex zone on either side of the guide member. This is because half the width of the guide member and the effective shading surface of one vortex plate is available as a flow shadow.

Particularly advantageous results are obtained if the median plane of the vortex plates are vertical to the plane of the screens. This ensures that no dead water areas form above the vortex plates and that vortex and turbulence formation is still particularly vigorous.

The pipe necessary for sucking off the cleaning bodies (or the pipes required in the case of several pipe openings along a guide member) can be led out downwards and then laterally out of the casing, or upwards through the guide member and then laterally out of the casing. It is a matter of the particular constructional circumstances, the latter constructional mode being particularly advantageous in the case of restricted space availability. In the case of screens in contact at the top of the V-shaped arrangement, there is obviously a cut-out in the screens at the appropriate point when the pipes are led downwards.

The V-shaped screen arrangement can obviously be supplemented with external screens, so that in all there is an M-shaped screen arrangement, which can be supplemented by further V-shaped arrangements. However, in this case, the outermost screens forming a narrowing gap with the cross-sectionally circular casing wall are freed from cleaning bodies in a different way, namely through a central discharge opening in said wall. It is possible to use flow aid for driving the cleaning bodies toward the discharge opening and these are known from German Pat. No. 32 15 443.

Embodiments of the invention are described in greater detail hereinafter relative to the drawings, wherein show:

FIG. 1, a simplified cross-sectional view through an apparatus according to the invention with a pair of funnel-shaped screens.

Figure 2:
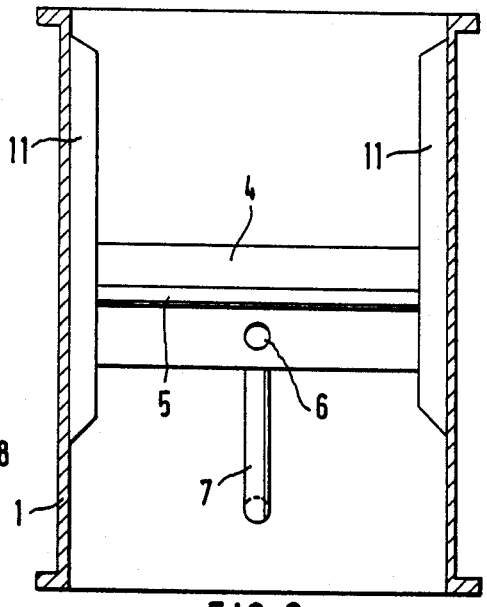

FIG. 2, a cross-sectional view of the apparatus according to FIG. 1 in a sectional view turned by 90° about the vertical.

Figure 3:
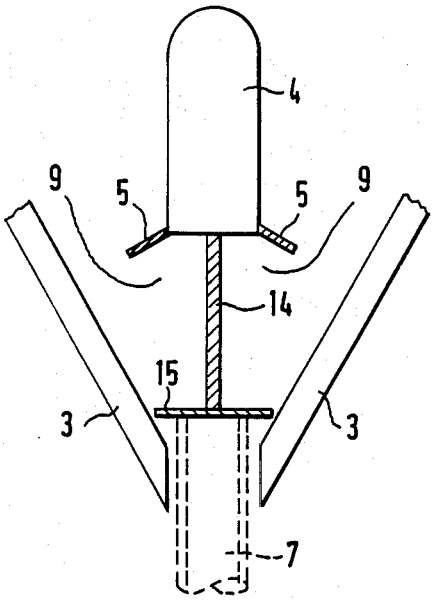

FIG. 3, a simplified cross-sectional view of the device for removing the cleaning bodies in the top of the screens arranged in funnel-shaped manner in a second embodiment of the invention.

Figure 4:
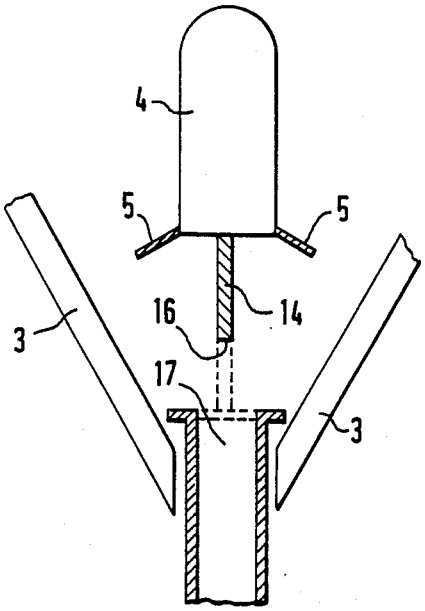

FIG. 4, a cross-sectional view according to FIG. 3 of the same embodiment in a different sectional plane.

Figure 5:
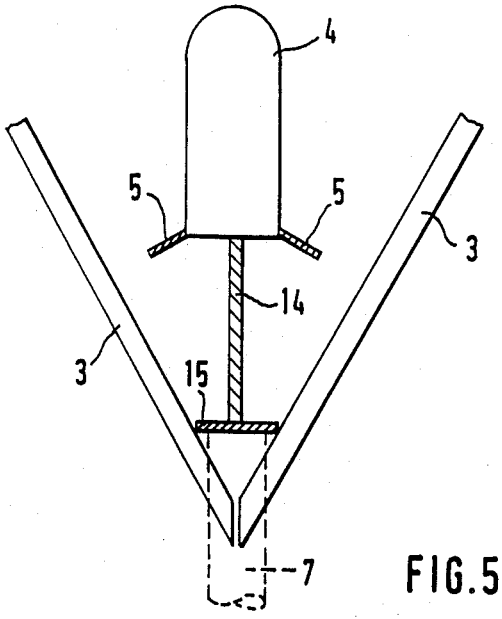

FIG. 5, a cross-sectional view according to FIGS. 3 and 4 of another embodiment.

Figure 6:
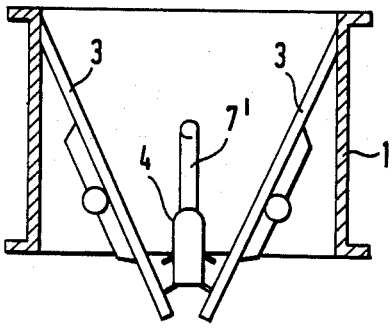

FIG. 6, a view according to FIG. 1 of another embodiment of the invention for obtaining a particularly low overall height.

Figure 7:
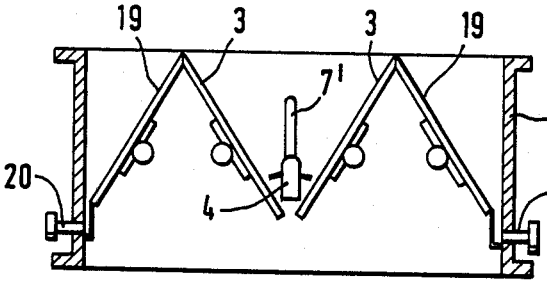

FIG. 7, a view according to FIG. 6 of another embodiment of the invention with central screens arranged in funnel-shaped manner and outer screens arranged in pointed roof-like manner.

The embodiment of an apparatus for extracting cleaning bodies from a cooling liquid shown in FIG. 1 comprises a casing 1, which is in the form of a pipe section. On the inside there are two screens 3 mounted on pivot pins 2 in a funnel-shaped or V-shaped manner and which are shown in the operating position. They collect the cleaning bodies in the form of sponge rubber balls from the cooling liquid flow flowing in from above, as for example a power station condenser and supply same to a strip-like, central section, in which is provided a guide member 4 having lateral vortex plates 5. With respect to the stagnation point of guide member 4, the vortex plates 5 are located at a distance where there are steady flow conditions, that is, where the cross-sectional constriction caused by guide member 4 has already led to a speed increase.

Below the vortex plates 5 there is provided a cross hole 6, from which leads a pipe 7 with an outer flange 8 at a point outside the casing. Cross hole 6 is located in the center of two vortex zones 9, which extend over the entire width (FIG. 2) of guide member 4 and ensure that in the triangular space formed by vortex plates 5, the lower screen portions and guide member 4, all cleaning bodies located therein are kept moving, i.e. can be floated by a transverse flow. The transverse flow is brought about by the cooling liquid flow quantity which flows into the cross hole 6.

FIG. 2 shows lateral members 11, which are used for the lateral sealing of screens 3. As a result of the position of the two pins 2 set away from the median plane of casing 1 pivoting of the screens 3 can only take place without engagement with the case 1, with all-around engagement in the operating position. With the aid of member 11 plane-parallel side regions are formed which laterally define screens. The invention operates in the known manner in this connection. Moreover, FIG. 2 does not show the screens whose pivot pins 2 are located below and above the plane of the paper.

FIG. 2 clearly shows that the guide member with the vortex plates 5 located therein is a through, straight body from which the pipe projects level with the cross hole. The cleaning bodies "dancing" in the vortex zone 9 below vortex plates 5 are gradually washed or floated towards cross hole 6 due to the cooling liquid quantity flowing out via cross hole 6 and pipe 7. As a result of existing turbulence, there may be temporarily outward movement of the individual cleaning bodies and this can be accepted, because in the case of a sufficiently long action time, as tests have shown, the suction removal of the cleaning bodies via cross hole 6 takes place in a reliable manner.

FIGS. 3 and 4 show another embodiment for the construction of the guide member, including its adjacent parts. Below the vortex plates 5 the much wider guide member 4 above said plates tapers to a web 14, which is bounded at its lower end by a deflector plate. FIG. 3 represents a sectional plane at a random point outside a pipe opening for the suction removal of cleaning bodies, whereas in FIG. 4 the suction point is shown in section. It is possible to see that web 14 is provided with an interruption 16 and that also the deflector plate 15 is interrupted to form a pipe opening 17.

Below the two vortex plates, which can be an integral part of the guide member 4 or can be subsequently fitted, as by welding, there are particularly large vortex zones 9, which bring about a vigorous movement of the cleaning bodies. The superimposed inflow to the pipe opening 17 once again ensures the transportaion of the cleaning bodies along web 14 towards the center or in the direction of the closest pipe opening 17, whereof several can be provided along guide member 4.

The above-described embodiments according to FIGS. 1 to 4 are particularly suitable for re-equipping existing apparatuses, in which bringing together cleaning bodies from a strip-like section to a single point is accomplished with the aid of a further V-shaped screen arrangement. Therefore, in the case of these embodiments, screens 3 are arranged in such a way that a specific distance is maintained between the lower ends.

The embodiment according to FIG. 5 makes it clear that the screens 3 can obviously also be arranged in such a way that the lower edges are in contact. On removing the cleaning bodies with the aid of pipe 7 in the downwards direction, recesses are provided in the vicinity of pipe 7 or pipes 7, if several are provided as a result of the considerable length of guide member 4. Otherwise the embodiment according to FIG. 5 is very similar to that of FIGS. 3 and 4.

FIG. 6 makes it clear that the suction of the cleaning bodies out of the vortex zones below the vortex plates 5 can also take place upwards through guide member 4, with the aid of a correspondingly positioned pipe 7'. In this case a particularly small overall height of the casing 1 is obtained, as can be clearly gathered from FIG. 6. The screens projecting over the lower edge and part of the guide member 4 do not generally have a prejudical effect, because a pipe is connected here, where there is sufficient space for receiving these part.

FIG. 7 shows that the inventive arrangement of guide member 4 with the vortex plates 5 thereon, in conjunction with screens 3 arranged in V-shaped manner can be combined with outer screens 19, with the aid of which the cleaning bodies passing on to them can be supplied to a single discharge tube 20 per screen 19. Once again, the pipe 7' for removing the cleaning bodies collected from the inner screens 3 is led upwards and then sideways out of the casing 1. The embodiment according to FIG. 7 demonstrates that the invention, apart from doubling, e.g. to a W-shaped arrangement, can also be combined with other screen types, so that in all there is an M-shaped arrangement, as shown in FIG. 7.

It is common to all the embodiments that the screens 3 and 19 are pivotable for the washing process to such an extent that there is a flow component, which washes through the screens "from below", so that adhering impurities are detached and can be floated off. However, the invention adopts known procedures in this connection, so that there is no need for a detailed description. This also applies with respect to the use and handling of the cleaning bodies, which in most different ways are subject to a cleaning cycle, but which require a screen arrangement for extracting the cleaning bodies from the cooling liquid flow.

In the specific embodiment according to FIG. 1, the distance between the outer edge of each vortex plate 5 to the surface of the associated screen 3 is approximately 40 mm, the diameter of the cross hole 6 approximately 60 mm and the nominal width of pipe 7 80 mm. This gives extremely satisfactory results, namely all the cleaning bodies are removed from the cooling liquid flow, even if a certain time is required between the first contact of a cleaning body with one of the screens 3 and the actual flowing of said body into the cross hole 6. It is readily apparent that the cleaning bodies passing by chance onto one of the screens 3 in the vicinity of the cross hole have a greater chance of being sucked into the latter than cleaning bodies hitting the screens outwards in the vicinity of the casing wall.

I claim:

1. Apparatus for extracting cleaning bodies from a cooling liquid after flowing through the tubes of a heat exchanger, comprising a pipe section casing, at least one pair of screens arranged in a V-shaped manner mounted to be pivoted for through-washing, a device for receiving the cleaning bodies collected in a strip-like section from both screens, and a guide member arranged above the device directly upstream of the strip section, characterized in that said guide member is provided with two vortex means running parallel to said strip section, each said vortex means associated with one of the two screens for forming one vortex zone and at least one point within each vortex zone terminating in an opening of a pipe for sucking off the cleaning bodies, said guide member being disposed between the two vortex means and projecting upstream therefrom, and being so shaped that the formation of a flow stagnation zone between and upstream of said vortex means is substantially prevented.

2. Apparatus according to claim 1, characterized in that the vortex means is in each case constructed as vortex plates projecting from said guide member.

3. Apparatus according to claims 1 or 2, characterized in the lower end of each vortex zone having a deflector plate with the two screens below the diameter of the cleaning bodies to downwardly limit the screen surface.

4. Apparatus according to one of the claims 1 or 2, characterized in that said guide member is reduced to a web below said vortex means.

5. Apparatus according to claim 3, characterized in that each vortex plate is arranged with its median plane substantially vertical to the associated screen.

6. Apparatus according to one of claims 1 or 2, characterized in that the guide member and vortex means are constructed as integral components.

7. Apparatus according to claim 4, characterized in that the pipe opening is positioned in upwardly directed manner at the lower end of web and that the web is provided with a web interruption in the vicinity of pipe opening.

8. Apparatus according to one of the claims 1 or 2, characterized in that said pipe passes upwards through the guide member.

9. Apparatus according to one of the claims 1 or 2, characterized in that said pipe is led downwards from a cross hole is said guide member below said vortex and that the lower edges of said screens are against each other in the vicinity of said pipe.

10. Apparatus according to one of claims 1 or 2, characterized in that the outer sides of said screens, within casing are provided with one further screen for forming an overall M-shaped screen arrangement and that the outer screens force the cleaning bodies towards one discharge tube in the casing wall.

11. Apparatus for extracting cleaning bodies from a cooling liquid after flowing through the tubes of a heat exchanger, comprising a pipe section as a casing, at least one pair of screens arranged in a V-shaped manner and which can be pivoted for through-washing, a device for receiving the cleaning bodies collected in a strip-like section from both screens and a guide member, characterized in that the guide member is provided with two vortex means running parallel to the strip section and in each case is associated with one of the two screens for forming in each case one vortex zone and that at one or more points within each vortex zone terminates an opening of a pipe for sucking off the cleaning bodies, said guide member being disposed between the two vortex means and projecting upstream therefrom, and being so shaped that the formation of a flow-stagnation zone between and upstream of said vortex means is substantially prevented.

* * * * *